US008317236B2

(12) United States Patent
Hill et al.

(10) Patent No.: US 8,317,236 B2
(45) Date of Patent: Nov. 27, 2012

(54) APPLIANCE DRAWER AND LATCH MECHANISM THEREFOR

(75) Inventors: Chris H. Hill, Ames, IA (US); Jason D. Miller, Alden, IA (US)

(73) Assignee: Electrolux Home Products, Inc., Charlottle, NC (US)

( * ) Notice: Subject to any disclaimer, the term of this patent is extended or adjusted under 35 U.S.C. 154(b) by 1197 days.

(21) Appl. No.: 12/103,831

(22) Filed: Apr. 16, 2008

(65) Prior Publication Data

US 2009/0261697 A1 Oct. 22, 2009

(51) Int. Cl.
*E05C 19/10* (2006.01)

(52) U.S. Cl. ..... 292/95; 292/96; 292/99; 292/121

(58) Field of Classification Search ..... 292/95, 292/96, 99, 101, 121, 122, 127, 128, 194, 292/195, 198, 202, 219, 220, 227, 228, DIG. 11, 292/DIG. 37, DIG. 69
See application file for complete search history.

(56) References Cited

U.S. PATENT DOCUMENTS

| | | | | | |
|---|---|---|---|---|---|
| 1,706,085 | A | * | 3/1929 | Straubel | 312/333 |
| 2,337,894 | A | * | 12/1943 | Jacobi | 292/227 |
| 2,670,981 | A | | 3/1954 | Wenham | |
| 2,889,787 | A | | 6/1959 | Schell | |
| 3,015,435 | A | * | 1/1962 | Hecker | 235/22 |
| 3,638,457 | A | | 2/1972 | Filipak | |
| 4,099,757 | A | * | 7/1978 | Palmer et al. | 292/336.3 |
| 4,655,489 | A | | 4/1987 | Bisbing | |
| 4,657,291 | A | | 4/1987 | Kurosaki | |
| 4,660,871 | A | | 4/1987 | Arakawa et al. | |
| RE32,456 | E | * | 7/1987 | Ishii | 200/61.61 |
| 4,709,949 | A | | 12/1987 | Umezawa et al. | |
| 4,779,906 | A | | 10/1988 | Kurosaki | |
| 4,792,165 | A | | 12/1988 | Nishimura | |
| 4,875,721 | A | | 10/1989 | Okamoto et al. | |
| 5,002,074 | A | | 3/1991 | Kimisawa | |
| 5,217,262 | A | | 6/1993 | Kurosaki | |
| 5,267,761 | A | | 12/1993 | Curtindale et al. | |
| 5,308,126 | A | * | 5/1994 | Weger et al. | 292/53 |
| 5,372,417 | A | * | 12/1994 | Buie et al. | 312/245 |
| 5,723,850 | A | * | 3/1998 | Lambert | 235/22 |
| 5,997,056 | A | | 12/1999 | Yamagishi | |
| 6,145,898 | A | | 11/2000 | Onderka et al. | |
| 6,213,533 | B1 | | 4/2001 | Widulle et al. | |
| 6,250,694 | B1 | | 6/2001 | Weiland | |
| 6,575,503 | B1 | | 6/2003 | Johansson et al. | |
| 6,669,250 | B1 | | 12/2003 | St. Louis | |

(Continued)

FOREIGN PATENT DOCUMENTS

DE 10061155 A1 6/2002

(Continued)

*Primary Examiner* — Thomas Beach
*Assistant Examiner* — Nathan Cumar
(74) *Attorney, Agent, or Firm* — Banner & Witcoff, Ltd

(57) ABSTRACT

An appliance drawer construction allows, upon the press of a button, the extension of the drawer from a housing. At the same time, inadvertent unintended opening caused, e.g., by a person's body brushing past or up against the appliance, may be avoided. In another aspect, the invention provides a simple and effective latch release linkage which is particularly well suited to a drawer, like a laundry washer additives dispenser drawer, that requires an offset of the latch from the operation push-button, due to the placement of an additive storage compartment portion of the drawer directly behind the front console of the drawer, and the space constraints within the housing that receives the drawer.

17 Claims, 7 Drawing Sheets

U.S. PATENT DOCUMENTS

| | | | | |
|---|---|---|---|---|
| 6,719,337 | B1 | 4/2004 | Ji | |
| 6,863,316 | B2 * | 3/2005 | Cole | 292/110 |
| 6,865,911 | B2 * | 3/2005 | Bolduan et al. | 68/17 R |
| 6,869,114 | B2 | 3/2005 | Ueki | |
| 7,032,936 | B2 | 4/2006 | Promutico | |
| 7,093,467 | B2 | 8/2006 | Kim et al. | |
| 7,097,220 | B2 | 8/2006 | Haba | |
| 7,108,298 | B2 | 9/2006 | Huet et al. | |
| 7,152,892 | B2 * | 12/2006 | Rechberg | 292/304 |
| 7,165,790 | B2 | 1/2007 | Bella et al. | |
| 7,188,871 | B2 | 3/2007 | Nemoto et al. | |
| 7,195,291 | B2 | 3/2007 | Kobayashi et al. | |
| 7,195,293 | B2 | 3/2007 | Ala | |
| 7,201,409 | B2 * | 4/2007 | Adachi et al. | 292/304 |
| 7,249,813 | B2 * | 7/2007 | Gasser | 312/333 |
| 7,815,267 | B1 * | 10/2010 | Frousiakis | 312/333 |
| 2003/0062730 | A1 | 4/2003 | Shirase | |
| 2004/0011089 | A1 | 1/2004 | Rizzeto et al. | |
| 2004/0075281 | A1 | 4/2004 | Ueki | |
| 2004/0263032 | A1 | 12/2004 | Cho | |
| 2006/0162392 | A1 | 7/2006 | Kwon et al. | |
| 2006/0255596 | A1 | 11/2006 | Yong | |
| 2007/0079637 | A1 | 4/2007 | Song | |

FOREIGN PATENT DOCUMENTS

| | | | |
|---|---|---|---|
| EP | 1449952 | A1 | 8/2004 |

* cited by examiner

APPLIANCE DRAWER AND LATCH MECHANISM THEREFOR

BACKGROUND OF THE INVENTION

The present invention relates to appliance drawer constructions, and particularly to constructions of additive dispenser drawers used in washing appliances, such as automated laundry washing machines.

Automated washing machines (such as laundry washing machines) often include mechanisms for dispensing additives into a washing chamber (e.g., a drum of a laundry washing machine). Such dispenser drawers typically contain receptacles for holding and dispensing different additives, which can include detergents, whiteners, fabric softeners, scents, rinse aids, etc. Typically, a user fills a dispenser chamber with one or more additives. At selected times during a wash cycle, water is then automatically introduced into the dispenser chamber and mixes with the additive. The water/additive mixture then flows out of the dispenser drawer and into a separate washing chamber, e.g., drum.

An example of a drawer-style additive dispenser is illustrated and described in commonly-owned U.S. Patent Application Publication No. 2004/0011089 (titled "Washing Aid Dispenser and Washing Machine Comprising Said Dispenser"). Access to the drawer by the user is obtained by withdrawing the drawer from an associated dispenser housing provided within the appliance cabinet. Typically, the drawer slides in and out of the dispenser housing along guideways provided on opposite sides of drawer, and on corresponding sides of the cavity that receives the drawer. The drawer is retracted manually, and no separate latching mechanism is generally provided, since the friction between the mating surfaces of the drawer and the dispenser housing, along with the generally horizontal orientation of the guideways (in the typical level appliance installation), are sufficient to retain the drawer in the desired extended or retracted position.

PGP US 2006/0162392 discloses a dispenser additives drawer with frictional slide glides, and also having a stopper and elastic slot that serve to releasably hold the drawer in its fully inserted position.

U.S. Pat. No. 6,865,911 discloses a childproof lock/latch mechanism in a washer additives dispenser drawer.

Apart from laundry additive dispenser drawers, other mechanisms are known which cause release of a drawer, or opening of a door. See, e.g., U.S. Pat. No. 7,188,871 (push-button of glove box releases a latch, which allows a spring to bias the closure lid open); U.S. Pat. No. 5,002,074 (push-push ashtray drawer with spring to bias drawer to extended position); and U.S. Pat. No. 4,875,721 (push-button released door of microwave range).

In a modern trend, laundry appliances are taking on a more prominent stylistic role in the home. Along with this, greater emphasis is being placed on convenience, user friendliness and the "look and feel" of laundry appliances. An additive dispenser drawer that operates more smoothly and easily than the existing dispenser drawers would be a significant improvement in this regard.

SUMMARY OF THE INVENTION

Aspects of the present invention provide an appliance drawer construction of improved operability, allowing, upon the press of a button, the extension of the drawer. At the same time, inadvertent unintended opening caused, e.g., by a person's body brushing past or up against the appliance, may be avoided. In another aspect, the invention provides a simple and effective latch release linkage which is particularly well suited to a drawer, like a laundry washer additives dispenser drawer, that requires an offset of the latch from the operation push-button, due to the placement of an additive storage compartment portion of the drawer directly behind the front console of the drawer, and the space constraints within the housing that receives the drawer.

The above and other objects, features and advantages of the present invention will be readily apparent and fully understood from the following detailed description of preferred embodiments, taken in connection with the appended drawings.

DETAILED DESCRIPTION OF THE PREFERRED EMBODIMENTS

Figure 1:
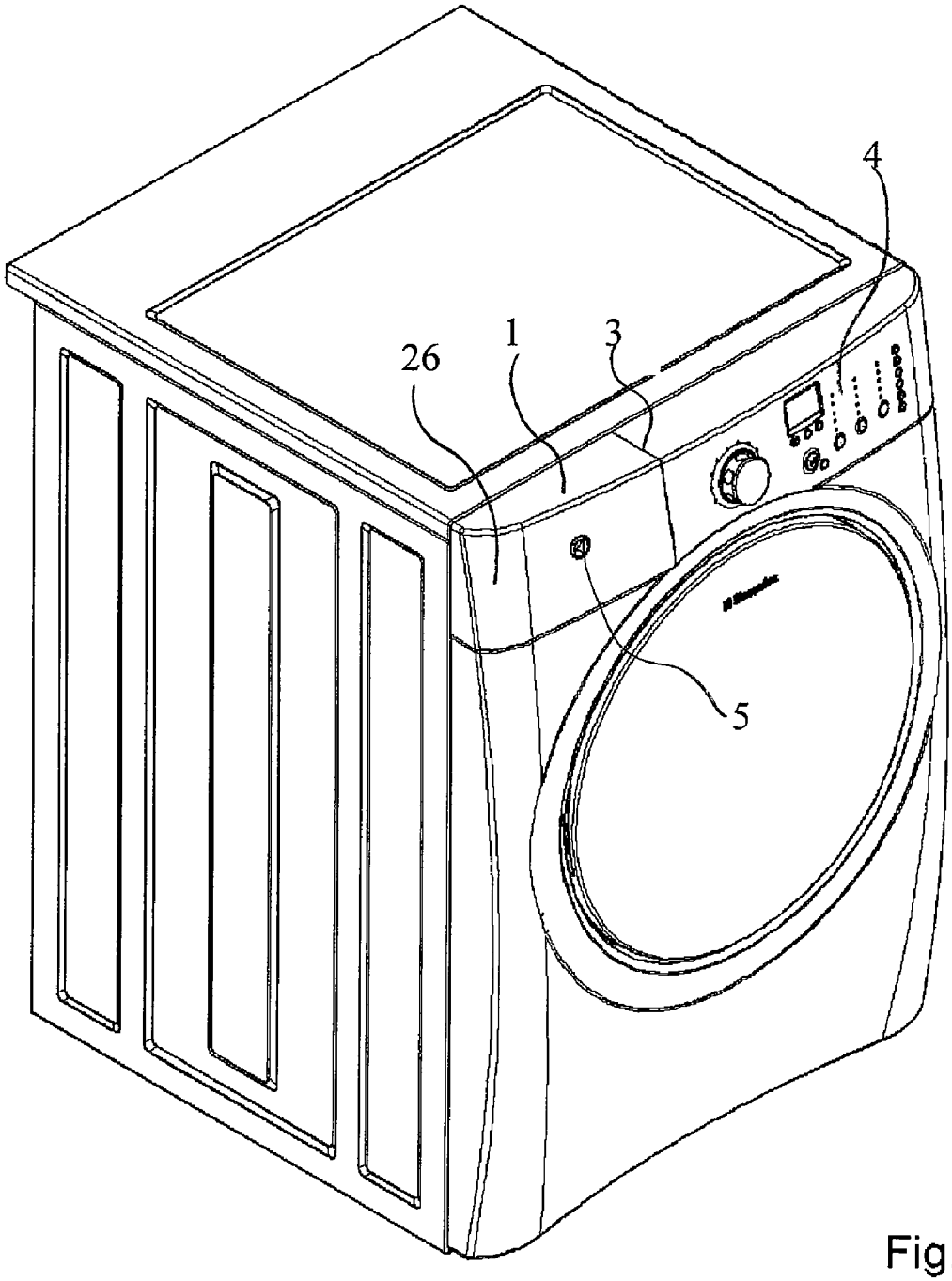
FIG. 1 is a front perspective view of a front load automatic laundry washer, including a push-button actuated additives dispenser drawer in accordance with an aspect of the invention.

Referring to FIG. 1, illustrated is an exemplary laundry washing appliance (machine) of the front-load, rotating drum variety. The washing machine includes an assembly of a drawer 1 and a housing 3 having a cavity that receives the drawer alongside a control panel 4 of the appliance. The drawer is extensible out of the housing to permit a user access to additive retention compartments of the drawer. Glides 6 (see FIG. 2) may extend along the sides of drawer 1 for making mating contact with corresponding bearing surfaces of the housing. This contact may comprise a sliding contact and/or a rolling contact, e.g., as may be provided by roller bearings. Incorporated into the housing, above the cavity, is an overhead water distribution tray 2 (see FIG. 7) for selectively delivering water into the drawer, in a generally known fashion. The assembly further includes a latch mechanism that serves to retain the drawer in the illustrated position, fully advanced into the housing. The latch mechanism includes a user operable latch release actuator, which may be a push-button 5 as shown. Referring to FIGS. 3-6, the latch mechanism further includes a first hook-like catch 7 carried by the drawer 1. Catch 7 is biased into engagement with a mating second catch 9 (see FIG. 6) provided on the housing, when the drawer is advanced into the housing (e.g., to the position shown in FIG. 1). Catch 9 may be provided in the form of an under-cut surface or the like, with a tapered guide surface adjacent thereto, for slidably guiding the first catch 7 into engagement with second catch 9 as drawer 1 is advanced fully into housing 3.

Figure 4:
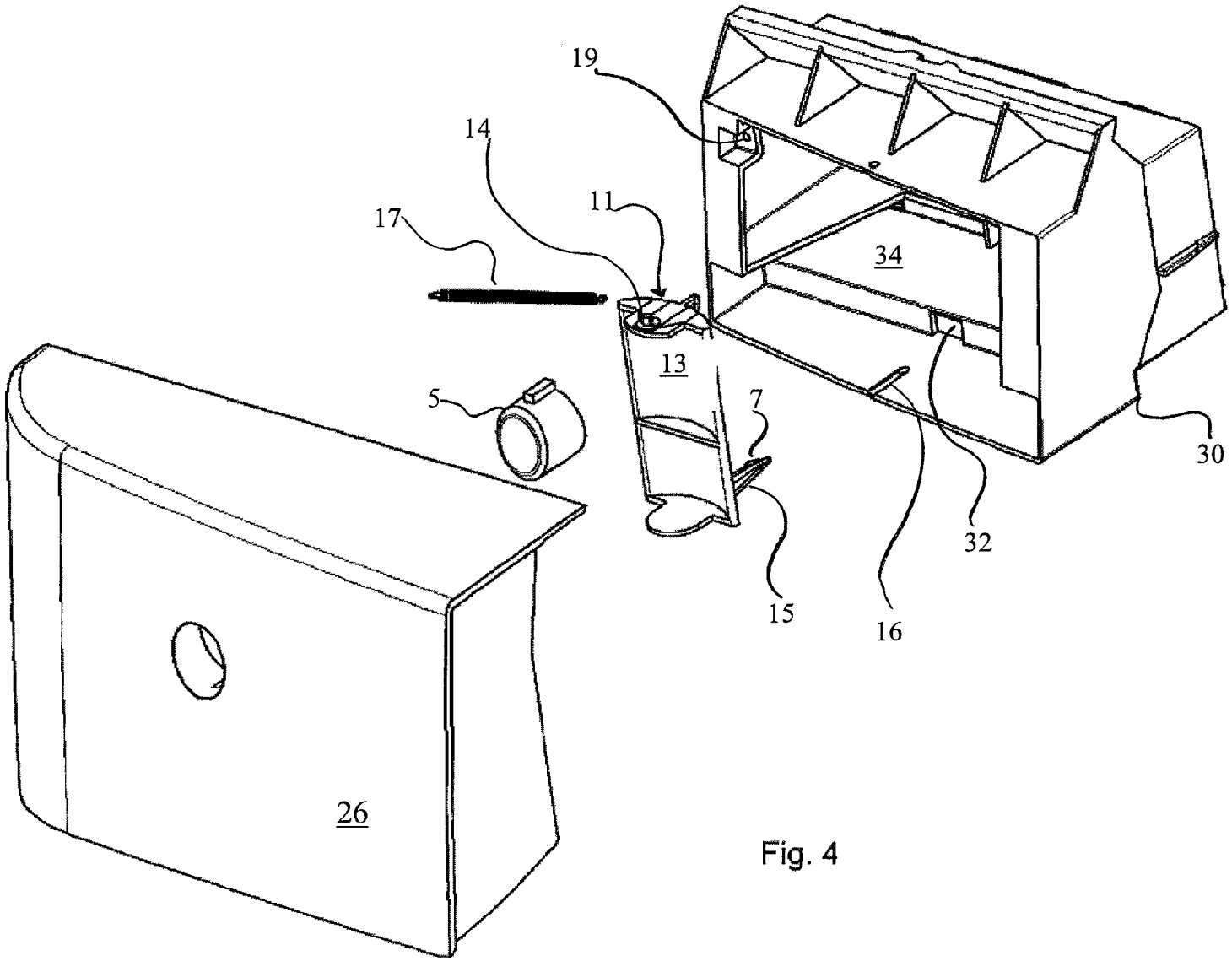
FIG. 4 is an exploded perspective view showing an assembly of parts of the exemplary additives dispenser drawer.
Figure 5:
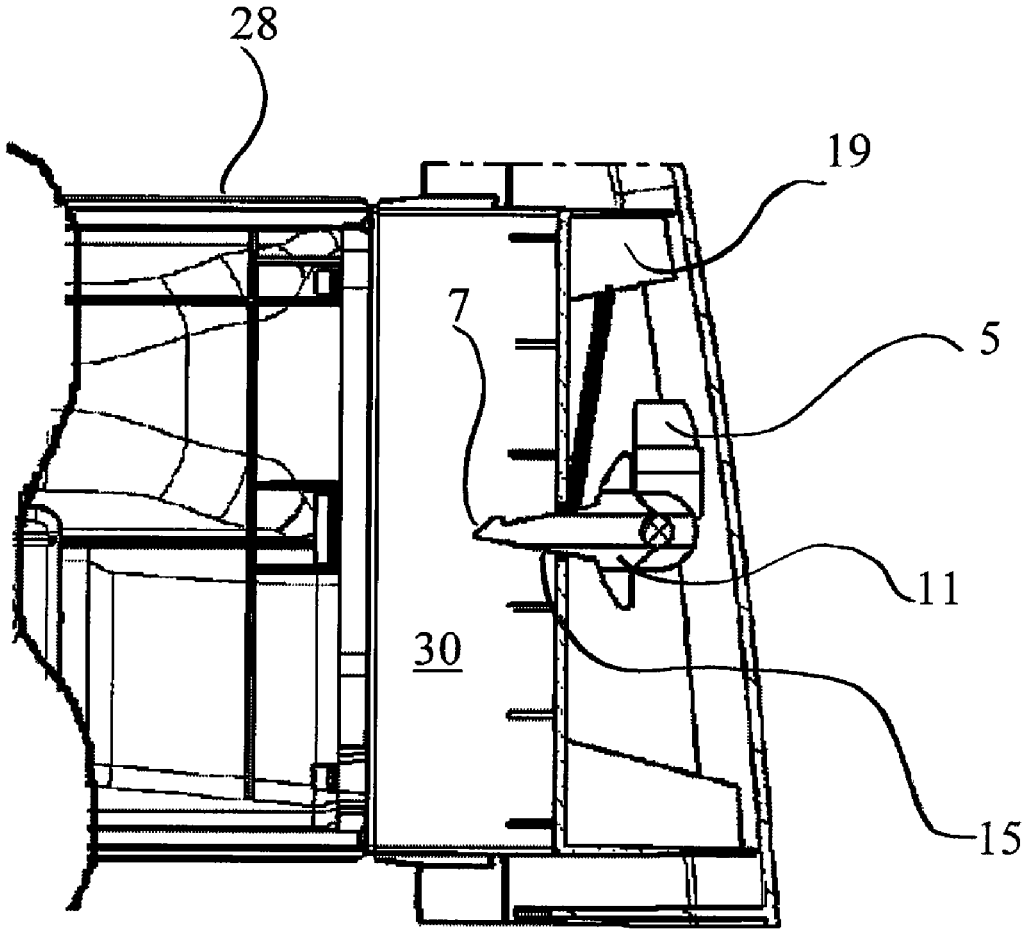
FIG. 5 is a partial bottom plan view, partially in section, of the exemplary additives dispenser drawer.
Figure 6:
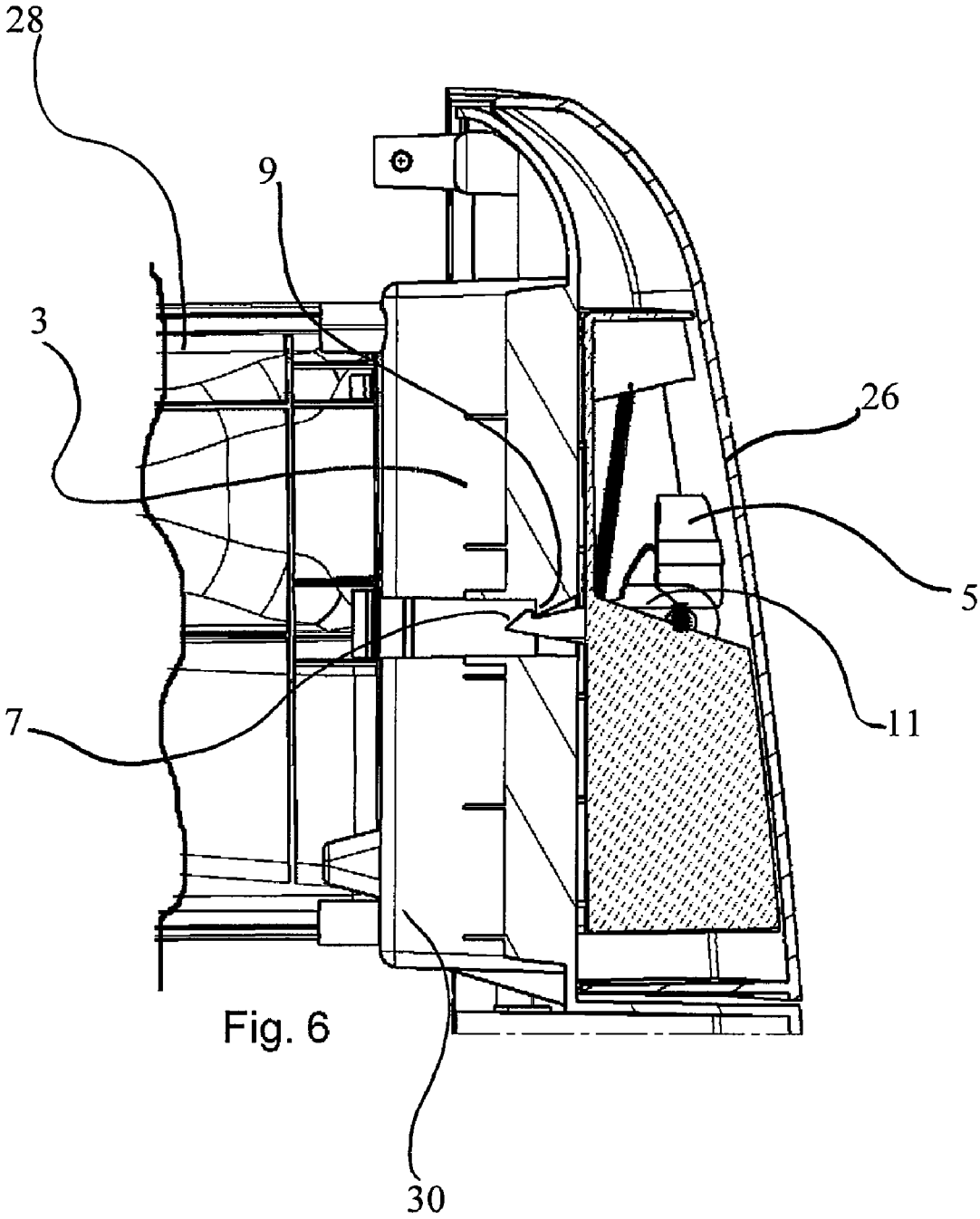
FIG. 6 is a partial bottom plan view of the additives dispenser drawer, with a portion cut-away to reveal components of the latch assembly thereof.

Push-button 5 is operably connected with first catch 7 so as to effect a disengagement of first catch 7 from second catch 9 upon being pressed. In particular, as shown in FIG. 5, the rear surface of push-button 5 engages with a laterally offset portion of a pivotably mounted linkage member 11. As button 5 is pressed, linkage member 11 rotates (counterclockwise in FIGS. 5 and 6). Referring to FIG. 4, linkage member 11 comprises a generally vertically extending, rib-reinforced, arcuate plate portion 13. An arm 15 extends rearwardly from vertically extending portion 13. Plate portion 13 has, on top and bottom flanges thereof, stub axles 14 (see FIG. 4—only one visible) received in corresponding slots 16 (only one visible) to provide the pivotal mount. First catch 7 is provided at a rearward end of arm 15 such that upon pivotable movement of linkage member 11, caused by a press of push-button 5, first catch 7 swings through a generally horizontal arc away from (and out of engagement with) the second catch 9.

A coil tension spring 17 is attached between the linkage member 11 and a side portion 19 (see FIGS. 4 and 5) of the drawer 1, to bias linkage member 11 for pivotal movement that moves first catch 7 into engagement with the second catch 9. Spring 17 also preferably preloads push-button 5 by pressing linkage member 11 against the rear side of push-button 5, thereby avoiding undesirable looseness or play between these components. A press of push-button 5 acts to pivot linkage member 11 against the spring bias to thereby cause the first catch 7 to disengage from the second catch 9 during the time that the button is pressed. Upon release of button 5, first catch 7 is returned to its original angular orientation, which may or may not be in engagement with second catch 9, as will be explained.

Figure 7:
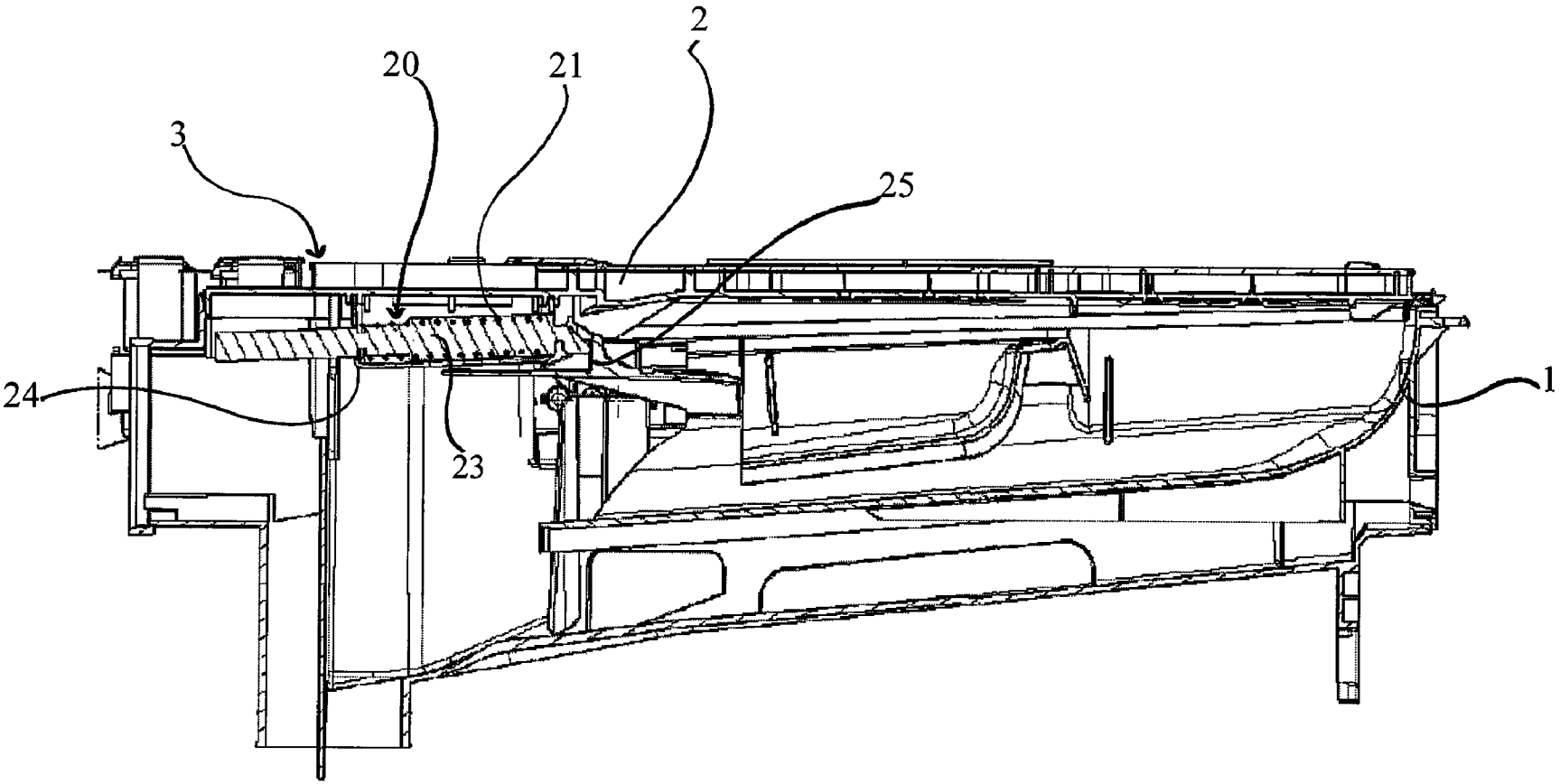
FIG. 7 is a longitudinal cross-sectional view of the additive dispenser drawer (front console omitted) received within the mating cavity of a housing of the additives dispenser.

The assembly further comprises a bias mechanism 20 (See FIG. 7) for biasing drawer 1 to move at least partially out of housing 3 upon a press of push-button 5, under a condition that the drawer is not blocked from moving outwardly. As seen in FIG. 7, bias mechanism 20 may comprise a compression spring 21 mounted upon a cylindrical guide rod 23 positioned in housing 3 behind inserted drawer 1. Guide rod 23 is mounted so as to allow limited axial movement of the rod forwardly and rearwardly. A rearward end of spring 21 abuts against an oppositely facing seat 24 provided at an upper rearward part of housing 3. The forward end of spring 21 is seated on a forward enlarged diameter portion of rod 23, such that spring 21 biases rod 23 axially outwardly to a position that places a forward end of guide rod 23 in contact with a rear push-surface 25 of drawer 1, when the drawer is fully advanced within the housing. This contact, upon full advancement of the drawer into the housing, also displaces rod 23 rearwardly against the bias of compression spring 21, so as to preload the spring to bias rod 23, and hence drawer 1, outwardly. As a result, upon disengagement of first catch 7 from second catch 9, the drawer will extend at least partially from the housing—so long as nothing is blocking it from doing so.

Under the aforesaid condition that the drawer is not blocked from moving outwardly, a spring-biased return of first catch 7 to its original angular orientation (upon a release of push-button 5) will not cause a reengagement of first catch 7 with second catch 9. Thus, drawer 1 will remain free to be manually extended further out of the housing to allow a user full access to the additive storage compartments of the drawer. On the other hand, in a condition that drawer 1 is blocked from moving outward at a time that push-button 5 is pressed, first catch 7 remains in a position to be biased back into engagement with second catch 9 upon a release of push-button 5, whereby the drawer remains secured within housing 3.

The foregoing arrangement is of highly significant functional consequence. Namely, it can serve to avoid a situation where a person brushing by or up against the appliance inadvertently cause the drawer to open (move outwardly). With an occurrence of "brush-by," it is possible that push-button 5 will be depressed, i.e., pushed inwardly causing a disengagement of the mating catches 7, 9. However, during this time, the person's hip or other body portion that inadvertently pressed button 5 will also typically be positioned so as to block drawer 1 from moving outwardly. Thus, in this condition, first catch 7 will remain in a position to be reengaged with second catch 9 upon a release of button 5, and thus drawer 1 will advantageously be retained in its latched, retracted position. The principal operative forces are diagrammatically depicted by arrows A-C in FIG. 2. Arrow A represents the pressing force on button 5. Arrow B represents the reaction force of a body portion resisting the outward bias force C generated by bias mechanism 20. Reaction force B is equal and opposite to bias force C, and thus the drawer is maintained stationary in its retracted position, despite a release of first catch 7 from second catch 9 by virtue of button-pressing force A.

The latch mechanism is preferably configured to permit the drawer to move sufficiently outwardly relative to push-button 5, upon disengagement of first catch 7 from second catch 9, to prevent a reengagement of the first catch with the second catch upon a user's release of push-button 5. In the illustrated arrangement, a press of button 5 causes an initial pivot of linkage member 11 sufficient to release first catch 7 from second catch 9. Thereafter, further rearward displacement of push-button 5 relative to drawer 1 is permitted to at least partially absorb the outward movement of drawer 1 caused by bias mechanism 20 upon a release of first catch 7 from second catch 9. In this manner, a press of push-button 5 by a user does not, by itself, inhibit a release of the drawer allowing it to be thereafter fully extended from the housing.

Figure 2:
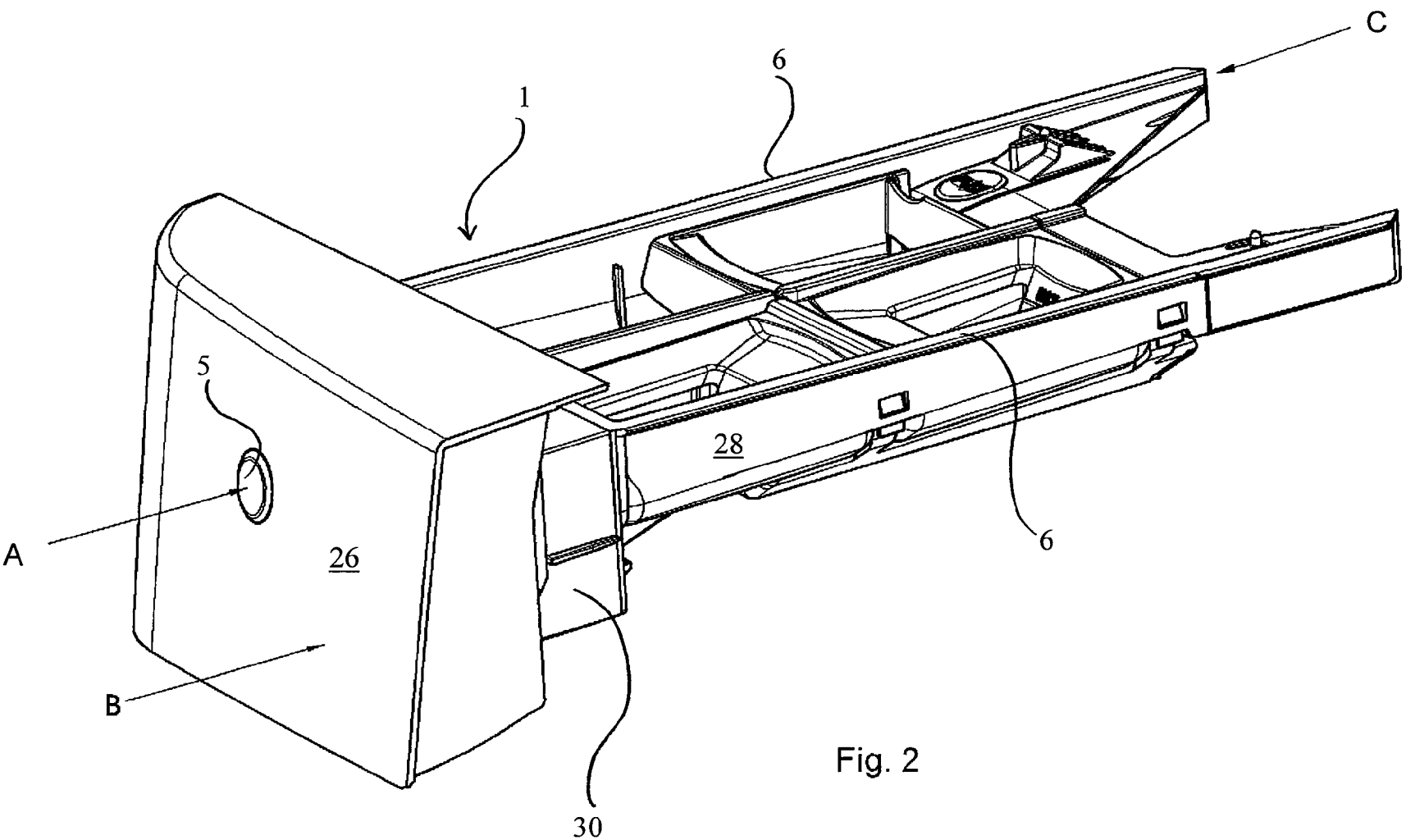
FIG. 2 is a right front side perspective view of the exemplary additives dispenser drawer shown installed in FIG. 1.
Figure 3:
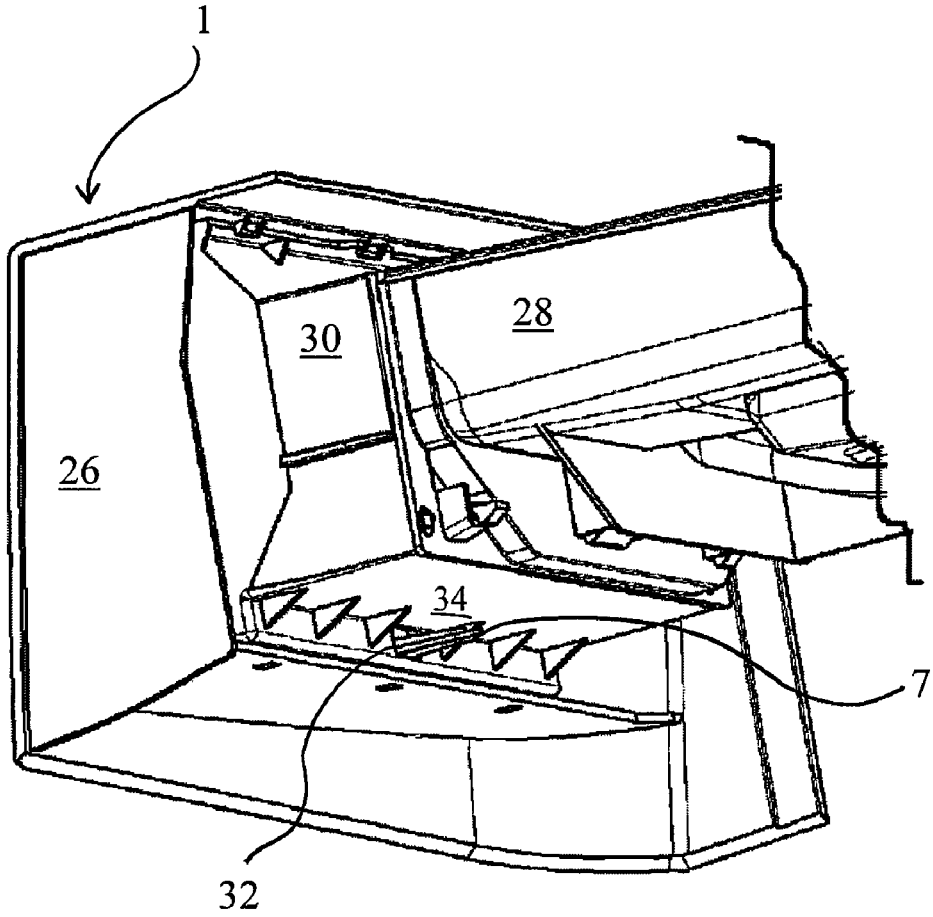
FIG. 3 is a right rear side partial perspective view of the exemplary additives dispenser drawer.

In the illustrated laundry washing machine additive dispenser drawer embodiment, the push-button actuator 5 is positioned on a front face or panel of a front console 26 of drawer 1. As seen in FIG. 2, elevation-wise, button 5 is positioned generally centrally at least partially above a bottom of the drawer compartment structure 28 attached at the rear side of console 26, through an intermediate joining member 30 of generally rectangular tubular shape. The first and second catches 7, 9 are vertically offset below the push-buttons so as to be positioned, elevation-wise, at least partially below the bottom of the drawer compartment. This offset is accomplished simply and effectively by way of the described arrangement of push-button actuator 5 and linkage member 11, including vertically extending portion 13 and arm 15. Such an arrangement advantageously permits the push-button to be positioned centrally on console 26 directly in front of the drawer compartment structure 28, while allowing the catches of the latch to be positioned where they can best be accommodated within the tight confines of the housing 3. As best seen in FIGS. 4 and 5, in the illustrated embodiment, arm 15 extends through an aperture 32 provided in a vertical step portion of joining member 30, to position catch 7 at a backside thereof, below a floor portion 34 of joining member 30. Mating second catch 9 may be provided within a depth-wise extending channel of a front console of housing, which aligns with aperture 32 upon insertion of drawer 1. In addition to lending additional structural rigidity to the console, such a channel can serve to provide a protective enclosure around the mating catches. So positioned, the mating catches may be protected and further concealed from view of the user. In addition, such an arrangement can serve to avoid fouling of the catch mechanism by spillage of additives poured into the drawer compartments.

In the illustrated embodiment, the housing is a housing that receives the drawer of an automated laundry washing machine, and the drawer is an additive dispenser drawer thereof. It will be understood, however, that aspects of the invention may be applied to other automatic washing appliances, e.g., dishwashing machines, and to appliance and other storage drawers in general.

The present invention has been described in terms of preferred and exemplary embodiments thereof. Numerous other embodiments, modifications and variations within the scope and spirit of the appended claims will occur to persons of ordinary skill in the art from a review of this disclosure.

The invention claimed is:

1. An assembly of a drawer and a housing that receives the drawer, said assembly further comprising a latch mechanism having a first catch carried by said drawer which is resiliently biased by a first bias mechanism also carried by said drawer into engagement with a mating second catch provided on said housing, when said drawer is advanced into said housing;

said latch mechanism further including a push-button actuator carried by said drawer and operably connected with said first catch so as to effect a disengagement of said first catch from said second catch upon being pressed, said assembly further comprising a second bias mechanism for biasing said drawer to move at least partially out of said housing upon a press of the push-button actuator under a condition that the drawer is not blocked from moving outwardly, and whereupon in a condition that the drawer is blocked from moving outward at a time that said push-button actuator is pressed, said first catch remains in a position to be biased back into engagement with said second catch by said first bias mechanism upon a release of said push-button actuator, whereby said drawer remains secured within said housing.

2. An assembly according to claim 1, wherein said housing is a housing of an automated washing machine, and said drawer is an additive dispenser drawer.

3. An assembly according to claim 2, wherein said automated washing machine is an automated laundry washing machine.

4. An assembly according to claim 1, wherein the latch mechanism is configured to permit the drawer to move sufficiently outwardly relative to the push-button actuator, upon disengagement of the first catch from the second catch, to prevent a reengagement of the first catch with the second catch upon a user's release of the push-button actuator, whereby a press of the push-button actuator by a user does not, by itself, inhibit a release of the drawer allowing it to be extended from the housing.

5. An assembly according to claim 1, said latch mechanism further comprising a pivotably mounted linkage member operably interconnecting said push-button actuator and said first catch.

6. An additive dispenser drawer assembly according to claim 5, wherein said pivotably mounted linkage member has a generally vertically oriented pivot axis.

7. An assembly of a drawer and a housing that receives the drawer, said assembly further comprising a latch mechanism having a first catch carried by said drawer which is biased into engagement with a mating second catch provided on said housing, when said drawer is advanced into said housing;

said latch mechanism further including a push-button actuator operably connected with said first catch so as to effect a disengagement of said first catch from said second catch upon being pressed, said assembly further comprising a bias mechanism for biasing said drawer to move at least partially out of said housing upon a press of the push-button actuator under a condition that the drawer is not blocked from moving outwardly, and whereupon in a condition that the drawer is blocked from moving outward at a time that said push-button actuator is pressed, said first catch remains in a position to be biased back into engagement with said second catch upon a release of said push-button actuator, whereby said drawer remains secured within said housing, wherein:

said pivotably mounted linkage member has a generally vertically oriented pivot axis;

said latch mechanism further comprises a pivotably mounted linkage member operably interconnecting said push-button actuator and said first catch; and said linkage member comprises a generally vertically extending portion and an arm extending rearwardly from said generally vertically extending portion, said first catch being provided at a rearward end of said arm such that upon pivotable movement of said linkage member said first catch swings through a generally horizontal arc toward or away from said second catch.

8. An additive dispenser drawer assembly according to claim 7, further comprising a spring attached to said linkage member to bias the same for pivotal movement that moves the first catch into engagement with said second catch, and wherein a press of said push-button actuator acts to pivot said linkage member against said bias to thereby cause said first catch to disengage from said second catch.

9. An additive dispenser drawer assembly of an automatic laundry appliance, including:

an additive dispenser drawer comprising a front panel, and a drawer compartment portion behind said front panel for holding and dispensing additives;

a housing of the appliance that receives the drawer; and a latch mechanism, said latch mechanism comprising a first catch carried by said drawer;

a second catch provided on said housing, said first catch being engageable with the second catch when said drawer is advanced into said housing; and a user operable latch release actuator carried by said drawer and operably connected with said first catch so as to effect, upon actuation, a disengagement of said first catch from said second catch;

wherein, said actuator is positioned on said front panel of said drawer and, elevation-wise, at least partially above a bottom of the drawer compartment; and said first and second catches are vertically offset from said actuator so as to be positioned, elevation-wise, at least partially below said bottom of the drawer compartment.

10. An additive dispenser drawer assembly according to claim 9, wherein said latch mechanism is biased to move the first catch into engagement with said second catch, and actuation of the latch release actuator acts to disengage said first catch from said second catch against said bias.

11. An additive dispenser drawer assembly according to claim 10, wherein said latch release actuator is a push-button actuator, and said latch mechanism further comprises a pivotably mounted linkage member operably interconnecting said push-button actuator and said first catch.

12. An additive dispenser drawer assembly according to claim 11, wherein said pivotably mounted linkage member has a generally vertically oriented pivot axis.

13. An additive dispenser drawer assembly according to claim 12, wherein said linkage member comprises a generally vertically extending portion and an arm extending rearwardly from said generally vertically extending, portion, said first catch being provided at a rearward end of said arm such that upon pivotable movement of said linkage member said first catch swings through a generally horizontal arc toward or away from said second catch.

14. An additive dispenser drawer assembly according to claim 13, further comprising a spring attached to said linkage member to bias the same for pivotal movement that moves the first catch into engagement with said second catch, and wherein a press of said push-button actuator acts to pivot said linkage member against said bias to thereby cause said first catch to disengage from said second catch.

15. An additive dispenser drawer assembly according to claim 11, further comprising a bias mechanism for biasing said drawer to move at least partially out of said housing upon a press of the push-button actuator under a condition that the drawer is not blocked from moving outwardly slightly relative to the push-button actuator, and whereupon in a condition that the drawer is blocked from moving outward slightly relative to the push-button actuator at a time that said actuator is pressed, said first catch remains in a position to be biased back into engagement with said second catch upon a release of said button, whereby said drawer remains secured within said housing.

16. An assembly of a drawer and a housing that receives the drawer, said assembly further comprising a latch mechanism having a first catch carried by said drawer which is resiliently biased by a first bias mechanism also carried by said drawer into engagement with a mating second catch provided on said housing, when said drawer is advanced into said housing;

said latch mechanism further including a push-button actuator operably connected with said first catch so as to move the first catch to effect a disengagement of said first catch from said second catch upon being pressed, said assembly further comprising a second bias mechanism for biasing said drawer to move at least partially out of said housing upon a press of the push-button actuator under a condition that the drawer is not blocked from moving outwardly, and whereupon in a condition that the drawer is blocked from moving outward at a time that said push-button actuator is pressed, said first catch remains in a position to be biased back into engagement with said second catch by said first bias mechanism upon a release of said push-button actuator, whereby said drawer remains secured within said housing.

17. An assembly according to claim 16, wherein said push-button actuator is carried by said drawer.

* * * * *